US006976539B2

(12) United States Patent
Metcalfe et al.

(10) Patent No.: US 6,976,539 B2
(45) Date of Patent: Dec. 20, 2005

(54) TUBING ANCHOR

(75) Inventors: Paul David Metcalfe, Peterculter (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/661,446

(22) Filed: Sep. 11, 2003

(65) Prior Publication Data

US 2004/0079528 A1 Apr. 29, 2004

Related U.S. Application Data

(63) Continuation of application No. 09/469,526, filed on Dec. 22, 1999, now Pat. No. 6,702,029.

(30) Foreign Application Priority Data

| | | |
|---|---|---|
| Dec. 22, 1998 | (GB) | 9828234 |
| Jan. 15, 1999 | (GB) | 9900835 |
| Oct. 8, 1999 | (GB) | 9923783 |
| Oct. 13, 1999 | (GB) | 9924189 |

(51) Int. Cl.[7] ..... E21B 23/00
(52) U.S. Cl. ..... 166/378; 166/208
(58) Field of Search ..... 166/378, 208, 166/207, 277, 380, 382, 327

(56) References Cited

U.S. PATENT DOCUMENTS

| | | | |
|---|---|---|---|
| 761,518 A | 5/1904 | Lykken | |
| 988,504 A | 3/1911 | Wiet | |
| 1,301,285 A | 4/1919 | Leonard | |
| 1,324,303 A | 12/1919 | Carmichael | |
| 1,545,039 A | 7/1925 | Deavers | |
| 1,561,418 A | 11/1925 | Duda | |
| 1,569,729 A | 1/1926 | Duda | |
| 1,597,212 A | 8/1926 | Spengler | |
| 1,880,218 A | 10/1932 | Simmons | |
| 1,930,825 A | 10/1933 | Raymond | |
| 1,981,525 A | 11/1934 | Price | 166/4 |
| 2,017,451 A | 10/1935 | Wickersham | 166/10 |

(Continued)

FOREIGN PATENT DOCUMENTS

| | | | |
|---|---|---|---|
| DE | 3 213 464 A1 | 10/1983 | B23D 45/12 |

(Continued)

OTHER PUBLICATIONS

UK Patent Office Search Report from GB 9928941.5, Dated Apr. 25, 2000.
PCT International Search Report from PCT/GB 99/04363, Dated Mar. 3, 2000.
Metcalfe, P.—"Expandable Slotted Tubes Offer Well Design Benefits", *Petroleum Engineer International,* vol. 69, No. 10 (Oct. 1996), pp. 60-63—XP000684479.
EP Office Action, Application No. 99 962 408.3-2315, dated May 19, 2004.

*Primary Examiner*—Frank S. Tsay
(74) *Attorney, Agent, or Firm*—Patterson & Sheridan, L.L.P.

(57) ABSTRACT

A method of installing a liner in a drilled bore below a section of bore previously lined with casing comprises the steps of: running a length of liner into the bore such that at least an upper end of the liner is positioned in overlapping relation with at least a lower end of the casing; and plastically deforming a portion of the liner such that an external face of the portion forms an interference fit with an internal face of a portion of the casing. The interference fit preferably provides both hanging support for the liner and a fluid-tight seal between the liner and casing.

13 Claims, 6 Drawing Sheets

U.S. PATENT DOCUMENTS

Figure 1:
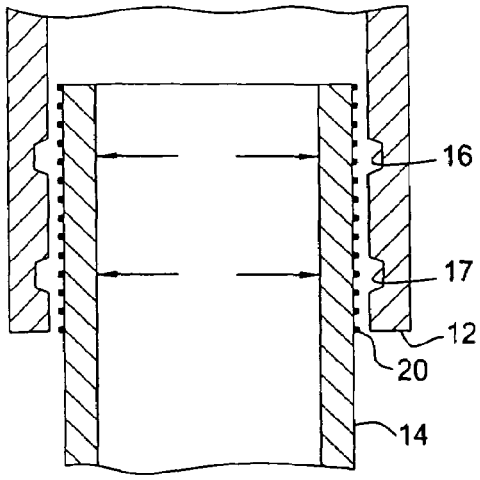

| | | | | |
|---|---|---|---|---|
| 2,214,226 | A | 9/1940 | English | 166/1 |
| 2,383,214 | A * | 8/1945 | Prout | 72/45 |
| 2,424,878 | A | 7/1947 | Crook | 154/82 |
| 2,499,630 | A | 3/1950 | Clark | 153/81 |
| 2,519,116 | A | 8/1950 | Crake | 166/10 |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,754,577 | A | 7/1956 | Maxwell | |
| 2,898,971 | A | 8/1959 | Hempel | 153/82 |
| 3,028,915 | A | 4/1962 | Jennings | 166/16 |
| 3,039,530 | A | 6/1962 | Condra | 166/55 |
| 3,087,546 | A | 4/1963 | Wooley | 166/46 |
| 3,167,122 | A | 1/1965 | Lang | 166/14 |
| 3,179,168 | A | 4/1965 | Vincent | 166/14 |
| 3,186,485 | A | 6/1965 | Owen | 166/63 |
| 3,191,677 | A | 6/1965 | Kinley | 166/14 |
| 3,191,680 | A | 6/1965 | Vincent | 166/46 |
| 3,195,646 | A | 7/1965 | Brown | 166/208 |
| 3,203,451 | A | 8/1965 | Vincent | 138/143 |
| 3,203,483 | A | 8/1965 | Vincent | 166/207 |
| 3,245,471 | A | 4/1966 | Howard | 166/46 |
| 3,297,092 | A | 1/1967 | Jennings | 166/207 |
| 3,326,293 | A | 6/1967 | Skipper | 166/150 |
| 3,353,599 | A | 11/1967 | Swift | 166/15 |
| 3,354,955 | A | 11/1967 | Berry | 166/14 |
| 3,467,180 | A | 9/1969 | Pensotti | 165/180 |
| 3,477,506 | A | 11/1969 | Malone | 166/207 |
| 3,489,220 | A | 1/1970 | Kinley | 166/277 |
| 3,583,200 | A | 6/1971 | Cvijanovic et al. | 72/393 |
| 3,669,190 | A | 6/1972 | Sizer et al. | 166/315 |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,382,379 | A | 5/1983 | Kelly | 73/46 |
| 4,387,502 | A | 6/1983 | Dom | 29/568 |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 B |
| 4,502,308 | A | 3/1985 | Kelly | 72/58 |
| 4,505,142 | A | 3/1985 | Kelly | 72/54 |
| 4,505,612 | A | 3/1985 | Shelley, Jr. | 405/101 |
| 4,531,581 | A | 7/1985 | Pringle et al. | 166/120 |
| 4,567,631 | A | 2/1986 | Kelly | 29/157.3 |
| 4,581,617 | A | 4/1986 | Yoshimoto et al. | 346/108 |
| 4,588,030 | A | 5/1986 | Blizzard | 166/120 |
| 4,626,129 | A | 12/1986 | Kothmann et al. | 405/43 |
| 4,697,640 | A | 10/1987 | Szarka | 166/120 |
| 4,807,704 | A | 2/1989 | Hsu et al. | 166/313 |
| 4,848,469 | A | 7/1989 | Baugh et al. | 166/382 |
| 4,866,966 | A | 9/1989 | Hagan | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang | 408/22 |
| 5,014,779 | A | 5/1991 | Meling et al. | 166/55.7 |
| 5,052,483 | A | 10/1991 | Hudson | 166/55 |
| 5,052,849 | A | 10/1991 | Zwart | 403/300 |
| 5,156,209 | A | 10/1992 | McHardy | 166/324 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 175/61 |
| 5,785,120 | A | 7/1998 | Smalley et al. | 166/55 |
| 5,787,933 | A * | 8/1998 | Russ et al. | 138/98 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,021,850 | A | 2/2000 | Wood et al. | 166/380 |
| 6,029,748 | A | 2/2000 | Forsyth et al. | 166/380 |
| 6,070,671 | A * | 6/2000 | Cumming et al. | 166/381 |
| 6,098,717 | A | 8/2000 | Bailey et al. | 166/382 |
| 6,135,208 | A | 10/2000 | Gano et al. | 166/313 |
| 6,325,148 | B1 | 12/2001 | Trahan | 166/297 |
| 6,425,444 | B1 | 7/2002 | Metcalfe et al. | 166/387 |
| 6,446,323 | B1 | 9/2002 | Metcalfe et al. | 29/523 |
| 6,454,013 | B1 | 9/2002 | Metcalfe et al. | 166/382 |
| 6,457,532 | B1 | 10/2002 | Simpson | 166/380 |
| 6,457,533 | B1 | 10/2002 | Metcalfe et al. | 166/381 |
| 6,527,049 | B2 | 3/2003 | Metcalfe et al. | 166/277 |
| 6,543,552 | B1 | 4/2003 | Metcalfe | 175/57 |
| 6,571,672 | B1 | 6/2003 | Rudd | 83/36 |
| 2001/0040054 | A1 | 11/2001 | Haugen | 175/61 |
| 2002/0166668 | A1 | 11/2002 | Metcalfe | 166/378 |

FOREIGN PATENT DOCUMENTS

| | | | |
|---|---|---|---|
| DE | 4133802 C1 | 10/1992 | F16L 9/12 |
| EP | 0 952 305 | 4/1998 | E21B 43/10 |
| EP | 0 881 354 | 12/1998 | E21B 43/10 |
| EP | 0 961 007 | 12/1999 | E21B 33/10 |
| GB | 730 338 | 3/1954 | 84/4 |
| GB | 792 886 | 4/1956 | |
| GB | 997 721 | 7/1965 | |
| GB | 1 448 304 | 9/1967 | E21B 33/13 |
| GB | 1 277 461 | 6/1972 | B21D 39/04 |
| GB | 1 457 843 | 12/1976 | B21D 39/10 |
| GB | 1 582 392 | 1/1981 | B21D 39/10 |
| GB | 2 216 926 A | 10/1989 | E21B 7/20 |
| GB | 2 313 860 B | 6/1996 | E21B 10/34 |
| GB | 2 320 734 | 7/1998 | E21B 33/127 |
| GB | 2 329 918 A | 4/1999 | E21B 43/10 |
| WO | WO 92/01139 | 1/1992 | E21B 17/08 |
| WO | WO 93/24728 | 12/1993 | E21B 17/10 |
| WO | WO 93/25800 | 12/1993 | E21B 43/10 |
| WO | WO 94/25655 | 11/1994 | D04C 1/06 |

| | | | | | | | |
|---|---|---|---|---|---|---|---|
| WO | WO 97/21901 | 6/1997 | ..... E21B 17/08 | WO | WO 99/18328 | 4/1999 | ..... E21B 23/01 |
| WO | WO 98/00626 | 1/1998 | ..... E21B 43/10 | WO | WO 99/23354 | 5/1999 | ..... E21B 43/10 |
| WO | WO 99/02818 | 1/1999 | ..... E21B 43/10 | | | | |
| WO | WO 99/06670 | 2/1999 | ..... E21B 43/10 | | | | |

* cited by examiner

TUBING ANCHOR

CROSS-REFERENCE TO RELATED APPLICATIONS

This application is a continuation of now abandoned U.S. patent application Ser. No. 09/469,526, filed Dec. 22, 1999, now U.S. Pat. No. 6,702,029 which is herein incorporated by reference.

BACKGROUND OF THE INVENTION

FIELD OF THE INVENTION

This invention relates to a tubing anchor, such as a liner hanger, that is an arrangement for locating and sealing a section of liner downhole relative to an existing casing. The invention also relates to a method and apparatus for use in providing such an anchor or hanger.

In oil and gas exploration and extraction, it is conventional to line the bores drilled to access subsurface hydrocarbon-bearing formations with steel tubing. The upper section of a bore is typically lined with steel casing, while the lower section of the bore is provided with "liner", which is hung off the lowermost section of casing. The liner is secured and sealed to the casing using a liner hanger comprising an arrangement of slips and elastomer seals, which seals may also serve to energise the slips.

Conventional liner hangers are relatively complex and expensive and occupy a significant annular space, necessary to accommodate both the gripping slip segments which support the weight of the liner and resist the differential pressure forces which may be generated across the liner/casing overlap and the elastomeric seals which prevent pressure leakage past the overlap. Accordingly, there may be a significant loss in bore diameter at the liner for example, accommodation of a 7" diameter liner normally requires provision of a 9⅝" diameter casing, and a 5" liner a 7" casing.

The maintenance of the integrity of the elastomeric seals used in conventional liner hangers has also proved problematic, particularly in high pressure high temperature wells, which are becoming increasingly more common.

In the majority of cases, the liner section will be cemented in place by pumping cement slurry down through the liner and back up the annular space between the liner and the borehole wall. Recent developments have resulted in the provision of mechanisms which allow the liner to be rotated during the cementing process. Rotating the liner improves cement coverage around the liner and the subsequent bond between the liner and the bore wall. These mechanisms typically consist of bearings which isolate the slip and seal sections of the liner hanger while the casing is rotated from the surface via the liner running tool assembly.

In addition, circulating ports are provided in the liner hanger to allow fluid displaced from the annulus by the cement slurry to bypass the liner hanger mechanism to the point where returning cement can also pass the liner hanger before the liner is finally set, thus ensuring that the annulus is filled with uncontaminated cement slurry.

The provision of these bearings and circulating ports add further complexity to an already complex system.

It is among the objectives of embodiments of the present invention to provide a liner hanger arrangement which obviates and mitigates at least some of these disadvantages. In particular, embodiments of the present invention provide relatively simple liner hangers which occupy only a very limited volume and which utilise metal-to-metal seals.

It is among the objectives of other embodiments of the present invention to provide a downhole method and apparatus for anchoring tubing, particularly expandable tubing, to a section of existing casing.

According to one aspect of the present invention there is provided a method of installing a liner in a drilled bore below a section of bore previously lined with casing, the method comprising the steps of:

running a length of liner into the bore such that at least an upper end of the liner is positioned in overlapping relation with at least a lower end of the casing; and plastically deforming a portion of the liner such that an external face of said portion forms an interference fit with an internal face of a portion of the casing to provide at least one of hanging support for the liner and a fluid-tight seal between the liner and casing.

The invention also relates to liner and casing for use in the method. In one embodiment of the invention, at least the portion of liner to be expanded is of a relatively ductile material.

The plastic deformation of the portion of liner to create an interference fit with the casing and provide hanging support for the liner obviates the requirement to provide slips or the like on the liner, and also a invention provide relatively simple liner hangers which occupy only a very limited volume and which utilise metal-to-metal seals.

It is among the objectives of other embodiments of the present invention to provide a downhole method and apparatus for anchoring tubing, particularly expandable tubing, to a section of existing casing.

According to one aspect of the present invention there is provided a method of installing a liner in a drilled bore below a section of bore previously lined with casing, the method comprising the steps of:

running a length of liner into the bore such that at least an upper end of the liner is positioned in overlapping relation with at least a lower end of the casing; and plastically deforming a portion of the liner such that an external face of said portion forms an interference fit with an internal face of a portion of the casing to provide at least one of hanging support for the liner and a fluid-tight seal between the liner and casing.

The invention also relates to liner and casing for use in the method. In one embodiment of the invention, at least the portion of liner to be expanded is of a relatively ductile material.

The plastic deformation of the portion of liner to create an interference fit with the casing and provide hanging support for the liner obviates the requirement to provide slips or the like on the liner, and also a mechanism to energise the slips, and thus the liner outside diameter may be relatively close to the inside diameter of the casing. The creation of fluid-tight seal obviates the requirement to provide conventional elastomeric seals requiring setting and energising.

Preferably, said portion of liner is deformed by rolling expansion, that is an expander member is rotated within the liner with a face in rolling contact with an internal face of said portion. The expander member may describe the desired diameter and is preferably urged radially outwardly into contact with the liner. Such rolling expansion causes compressive plastic deformation or yield of the liner and a localised reduction in wall thickness resulting in a subsequent increase in liner diameter.

Preferably, said deformed portion of the liner is annular.

Preferably, the portion of liner is deformed to create a pressure-tight seal between the liner and casing. Most preferably, the seal formed is a metal-to-metal seal. Conveniently, the portion of liner includes a relatively soft material, such as a relatively soft metal, which is plastically deformed during the expansion of the liner portion. The soft metal may be provided as an annular coating or insert. In other embodiments other sealing materials may be utilised, such as elastomers, or the relatively soft material may be provided on the casing.

The portion of liner may be deformed to extend into or otherwise engage a preformed profile in the casing. A step of a method in accordance with an embodiment of the invention may involve deforming the casing to define the profile prior to running the liner into the bore.

Alternatively, the portion of casing may also be deformed together with the liner, and the deformation of the casing may be elastic or plastic. The liner may be deformed at two or more axially spaced locations. Thus, the liner, and possibly also the casing, may be deformed to define a plurality of axially spaced profiles.

The liner may be initially secured in the casing, at least against relative rotation, by deforming the liner, in particular by radially extending circumferentially spaced areas of the liner to form corresponding areas of interference fit between the liner arid the casing. Preferably, these areas are then extended circumferentially to form annular areas of interference fit between the liner and casing.

The portion of the liner may carry relatively hard material on its external face, which material will tend to bite into the opposing faces of the liner and casing to provide a more secure coupling therebetween. The material is preferably in the form of relatively small discrete particles or pieces, such as balls, chips or the like of relatively hard metal such as tungsten carbide. The hard material may be held in a matrix of softer material.

The method may further comprise the step of cementing the liner in the bore. This may be achieved by pumping cement from surface to the lower end of the liner, preferably through a combined running and cementing string and tool, directing the cement into the annulus between the liner and the bore wall and displacing well fluid from the annulus, to substantially fill the annulus with cement. Preferably, the portion of the liner is expanded once the cement is in place in the annulus; the displaced well fluid may therefore pass between the upper end of the liner and the lower end of the casing. Preferably, the liner is rotated as the cement is passed into the annulus; thus, there is preferably a releasable coupling between the running tool and the liner to permit transfer of torque therebetween.

Preferably, the liner is run into the bore on a running tool carrying an expander including a body and at least one radially extendable member mounted thereon, the running tool being rotatable to move the member around the portion of the liner to create the desired deformed portion. Preferably, the member is a roller, and the roller may define a raised surface portion to create a high pressure contact area. The expander may be provided with two or more rollers, and a plurality of the rollers may be radially movable. Most preferably, the member is fluid pressure actuated, but in the other embodiments may be mechanically actuated. Conveniently, the member is coupled to an axially movable fluid pressure actuated piston, the piston defining a cam face for engaging a cooperating cam face on the member. In other embodiments, the expander may include a cone or the like, and the cone may carry a number of rollers for engaging and expanding the liner. A cleaning pig, a wiper, or the like may be run through the liner running string and expander prior to activating the expander.

According to a further aspect of the present invention there is provided a method of securing a liner in a drilled bore to a section of previously fitted casing, the method comprising the step of circumferentially expanding a portion of the liner by compressive plastic deformation to produce a localised reduction in wall thickness such that an external face of said portion forms an interference fit with an internal face of a portion of the casing to provide at least one of hanging support for the liner and a fluid-tight seal between the liner and casing.

Preferably, said portion of liner is deformed by rolling expansion, that is an expander member is rotated within the liner with a face in rolling contact with an internal face of said portion. The expander member may describe the desired diameter and is preferably urged radially outwardly into contact with the liner.

According to another aspect of the present invention, there is provided a liner running and setting tool comprising: a body for mounting on a running string and for location with a portion of liner to be positioned within a portion of casing; and a radially movable expander member mounted on the body, the member being movable to plastically deform the liner portion such that an external face of the portion forms an interference fit with an internal face of the casing portion to provide at least one of hanging support for the liner and a fluid-tight seal between the liner and casing.

Preferably, the tool is adapted to be selectively rotatable relative to the liner and the expander member is a roller such that the portion of liner may be deformed by rolling expansion, that is the expander member is rotated within the liner with a face in rolling contact with an internal face of said portion. Preferably, the roller defines a raised surface portion to create a high pressure contact area. The tool may be provided with two or more rollers, and a plurality of the rollers may be radially movable.

Preferably, the member is fluid pressure actuated. Conveniently, the member is coupled to an axially movable piston, the piston defining a cam face for engaging a cooperating cam face on the member. In ether embodiments, the expander may include a cone or the like, and the cone may carry a number of rollers for engaging and expanding the liner. Alternatively, the members may be piston mounted. The tool may include axially spaced expansion members, whereby the liner may be deformed simultaneously at two spaced locations. However, it is preferred that the expansion of the liner occurs only at one axial location at a time; the expansion member may then be moved axially within the liner to another location if desired.

Preferably, the tool defines a throughbore to permit cement to be passed through the tool.

Preferably also, the tool comprises a coupling for releasably engaging the liner to permit transfer of torque therebetween. The coupling may be released on activation of the expander member, to permit rotation of at least the expander member relative to the liner.

The tool may be provided in combination with a section of liner, wherein at least the portion of liner to be expanded is of a relatively ductile material. Preferably, the portion of liner includes a relatively soft material on an outer surface thereof, such as a relatively soft metal, which may be plastically deformed during the expansion of the liner portion. The soft metal may be provided as an annular coating or insert. In other embodiments other sealing materials may be utilised, such as elastomers. The portion of the liner may carry relatively hard material on its external face, which material will tend to bite into the opposing faces of the liner and casing to provide a more secure coupling therebetween. The material is preferably in the form of relatively small discrete pieces, such as balls, chips or the like of relatively hard metal such as tungsten carbide. The hard material may be held in a matrix of softer material.

According to a still further aspect of the present invention there is provided a solid liner wherein at least a portion of the liner is of a relatively ductile material, to facilitate deformation and circumferential expansion thereof.

Said portion of the liner may be formed by selectively heat treating a section of the liner, or may be formed of a different material and be coupled, for example by welding or via a screw thread, to the less ductile portion of liner.

According to a still further aspect of the present invention there is provided a method of anchoring expandable tubing downhole, the method comprising: running a section of expandable tubing into a bore such that at least a portion of the expandable tubing is located within of a section of existing tubing; locating a radially extendable tool within said portion and activating said tool to plastically deform and circumferentially expand said portion into contact with the existing tubing and anchor the expandable tubing thereto.

The invention thus allows a section of expandable tubing to be anchored in a bore without requiring the provision of conventional anchors, tubing hangers or coupling arrangements, such as radially extendable keys and corresponding profiles.

Said portion of the expandable tubing will typically be an end portion of the tubing, and may be the leading or following end of the tubing.

Preferably, relatively ductile material, typically a ductile metal, is provided between the portion of expandable tubing and the existing tubing, and conveniently the material is carried on the outer surface of the expandable tubing. Thus, on expansion of the inner tubing the ductile material will tend to flow or deform away from the points of contact between the less ductile material of the expandable tubing and existing tubing creating a relatively large contact area; this will improve the quality of the seal between the sections of tubing. Most preferably, the material is provided in the form of a plurality of axially spaced bands. The expandable tubing and the existing tubing will typically be formed of steel, while the relatively ductile material may be lead or another relatively soft metal, or may even be an elastomer. Preferably, relatively hard material may be provided between the portion of expandable tubing and the existing tubing, such that on circumferential expansion of the expandable tubing the softer material of one or both of the expandable and existing tubing deforms to accommodate the harder material and thus facilitates in anchoring the expandable tubing. Most preferably, the relatively hard material is provided in the form of relatively small individual elements, such as sharps, grit or balls of carbide or some other relatively hard material, although the material may be provided in the form of bands or the like. Most preferably, the relatively hard material is carried in a matrix of relatively ductile material.

Preferably, the radially extendable tool is run into the bore together with the expandable tubing. Preferably, the tool defines a plurality of circumferentially spaced tubing engaging portions, at least one of which is radially extendable. Preferably, the tool is rotated following extension of said at least one tubing engaging portions to produce an circumferential contact area between the expandable tubing and the existing tubing.

Preferably, following anchoring of the expandable tubing in the existing tubing, the tool is advanced through the tubing to expand the tubing.

According to another aspect of the present invention there is provided apparatus for use in anchoring expandable tubing downhole, the apparatus comprising a body for location in a portion of expandable tubing and carrying a plurality of circumferentially spaced tubing engaging portions, at least one of the tubing engaging portions being radially extendable to increase the effective diameter defined by the tubing engaging portions and to produce plastic deformation of the expandable tubing where the tubing engaging portions contact the expandable tubing sufficient to anchor the expandable tubing in a surrounding tubing.

The invention also relates to the use of such an apparatus to form an anchor.

Preferably, the apparatus comprises at least two and preferably three tubing engaging portions.

Preferably, the tubing engaging portions define rolling surfaces, such that following radial extension of said at least one tubing engaging portion the body may be rotated to create a circumferentially extending area of contact between the expandable tubing and the surrounding tubing. In other embodiments the extension may be created in a step-wise fashion.

Most preferably, the tubing engaging portions are in the form of radially movable rollers. The rollers may have tapered ends for cooperating with tapered supports. At least one of the tapered supports may be axially movable, such movement inducing radial movement of the rollers. Preferably also, each roller defines a circumferential rib, to provide a small area contact surface.

Preferably, said at least one tubing engaging portion is fluid actuated. Most preferably, the tubing engaging portion is coupled to a piston; by providing a relatively large piston area with respect to the area of the portion which comes into contact with the tubing it is possible to produce high pressure forces on the tubing, allowing deformation of relatively thick and less ductile materials, such as the thicknesses and grades of steel conventionally used in downhole tubing and casing. Most preferably, a support for the tubing engaging portion is coupled to a piston, preferably via a bearing or other means which permits relative rotational movement therebetween.

The apparatus may be provided in conjunction with a downhole motor or the apparatus may be rotated from surface.

Figure 2:
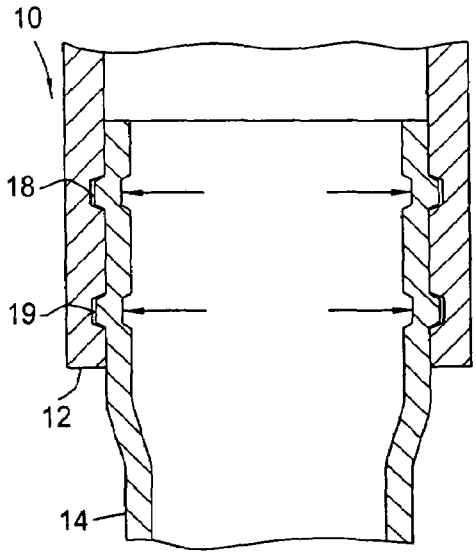

These and other aspects of the present invention will now be described, by way of example, with reference to the accompanying drawings, in which:

FIGS. 1 and 2 are schematic illustrations of the formation of a liner hanger in accordance with a first embodiment of the present invention;

FIGS. 3 and 4, FIGS. 5 and 6, FIGS. 7 and 8, FIGS. 9 and 10 and FIGS. 11 and 12 are schematic illustrations of the formation of liner hangers in accordance with other embodiments of the present invention.

Figure 13:
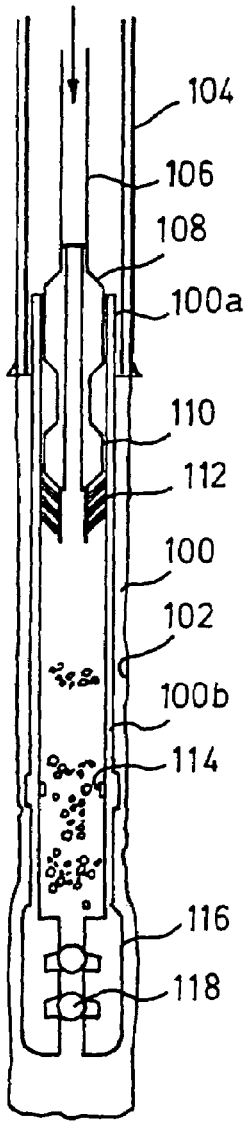
Figure 14:
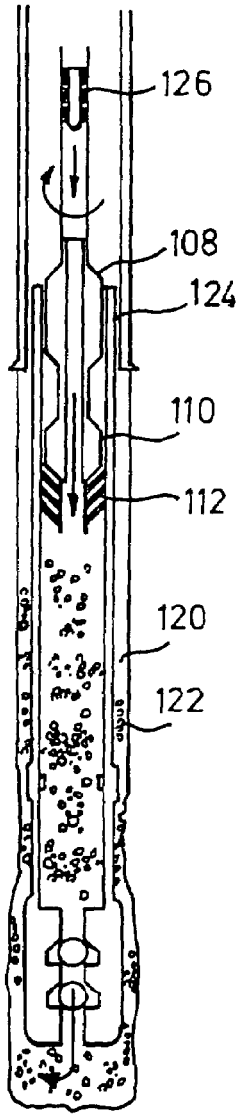
Figure 15:
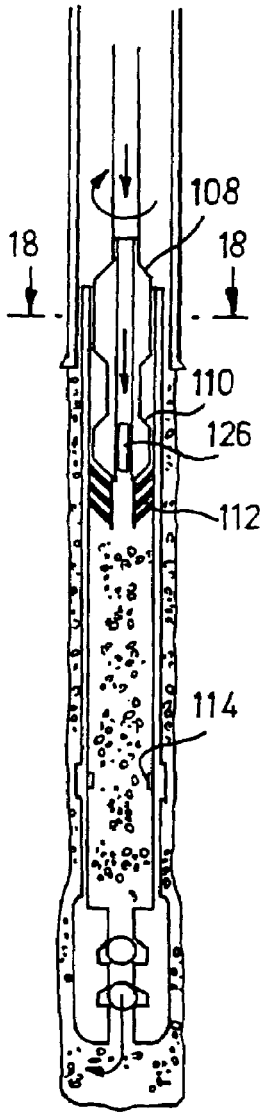
Figure 16:
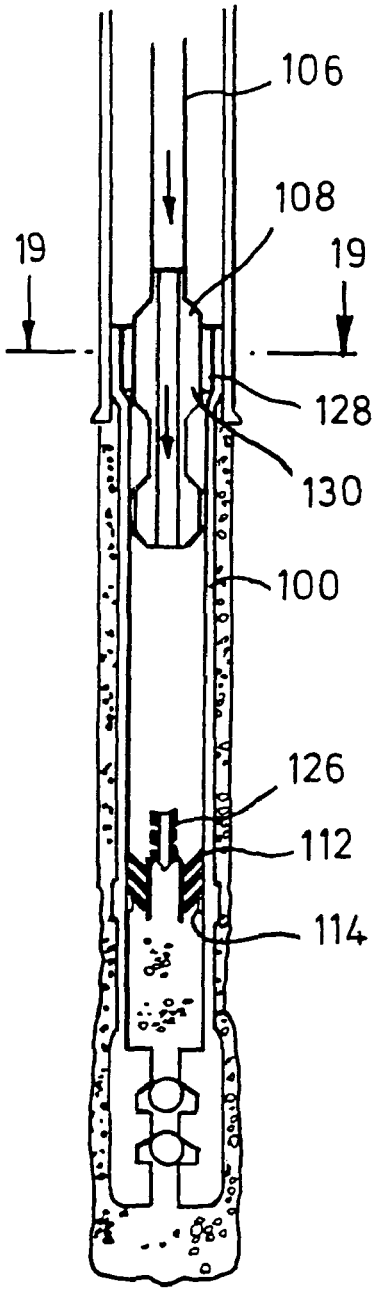
Figure 17:
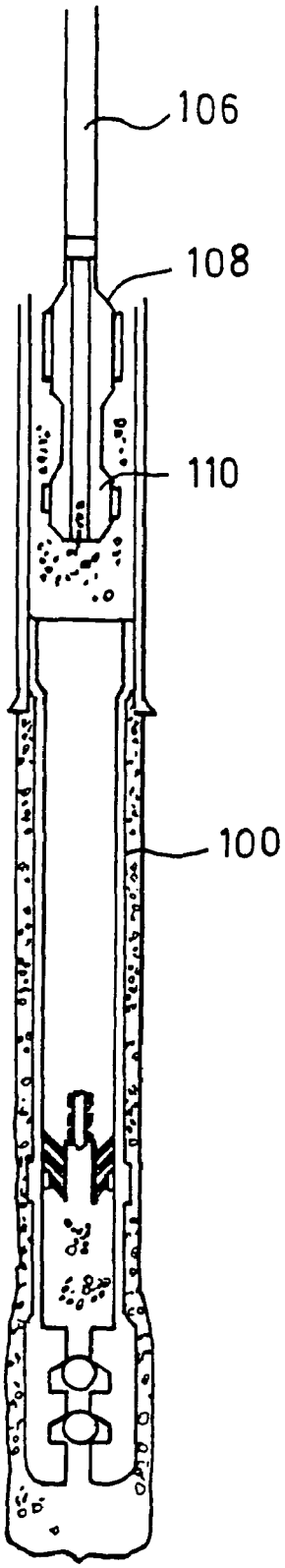
Figure 18:
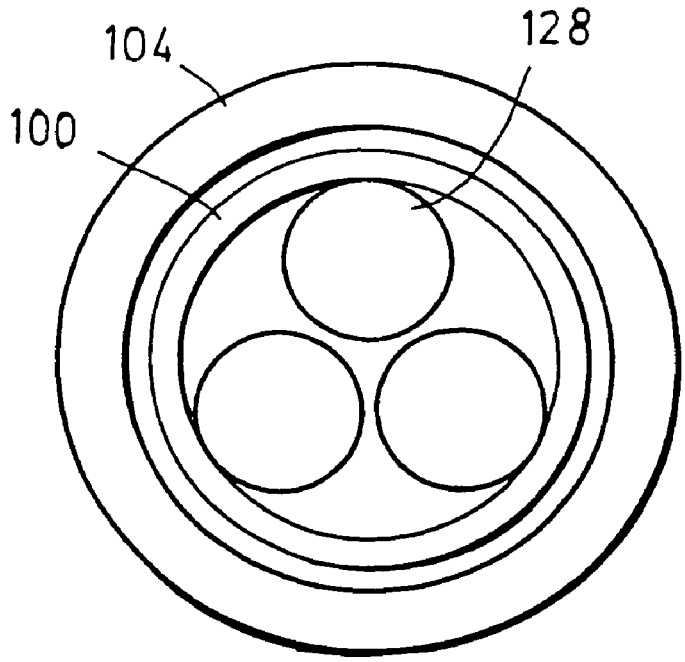
Figure 19:
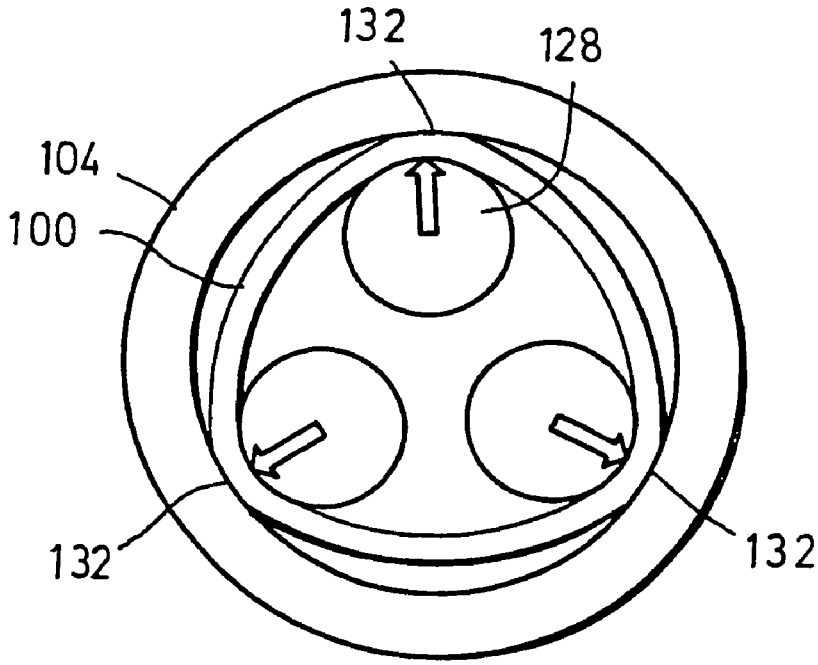

FIGS. 13 to 17 are schematic views illustrating steps in the running and setting of a liner in accordance with a preferred embodiment of the present invention; and FIGS. 18 and 19 are schematic sectional plan Views, on lines 18—18 and 19—19 of FIGS. 15 and 16 respectively, illustrating the initial temporary setting of the liner.

A variety of liner hangers in accordance with embodiments of the present invention will first be described, followed by a description of an apparatus and method which may be utilised to form the hangers.

Reference is first made to FIGS. 1 and 2 of the drawings which are schematic illustrations of the formation of a liner hanger 10 in accordance with a first embodiment of the present invention. The figures show the lower end of a section of pre-installed casing 12 and the upper end of a section of liner 14 which has been run into a borehole lined with casing 12. The upper end of the liner 14 is positioned in overlapping relation with the lower end of the casing 12.

The casing 12 features two axially spaced annular female profiles 16, 17. As will be described, the upper end of the liner 14 is deformed by rolling expansion, that is an expander member in the form of a roller is rotated within the liner 14 with a face in rolling contact with the internal face of the liner, to cause compressive plastic deformation of the liner 14 and a localised reduction in wall thickness resulting in a subsequent increase in liner diameter, as is apparent from FIG. 2. The expansion is carried out in two steps, and the expanding rollers feature a raised portion or rib such that the liner 14 experiences greater deformation at the area in contact with the raised portion, the raised portion being located, adjacent the casing profile 16, to form a corresponding male profile 18 in the liner 14. A second male profile 19 is created by moving the roller expander to a second lower location for the second step of the expansion process.

The interference fit between the expanded liner 14 and the casing 12, and also the cooperation between the profiles 16, 17, 18 and 19 is such that the resulting liner hanger 10 provides both hanging support for the liner 14 and a pressure-tight seal between the liner 14 and the casing 12.

To enhance the grip between the liner 14 and the casing 12, the liner 14 carries chips of carbide 20 held in a matrix of softer metal; on deformation of the liner 14, the carbide chips bite into the opposing faces of the liner 14 and casing 12.

Figure 3:
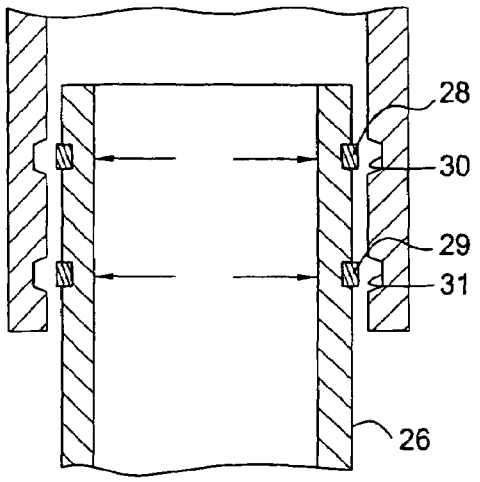
Figure 4:
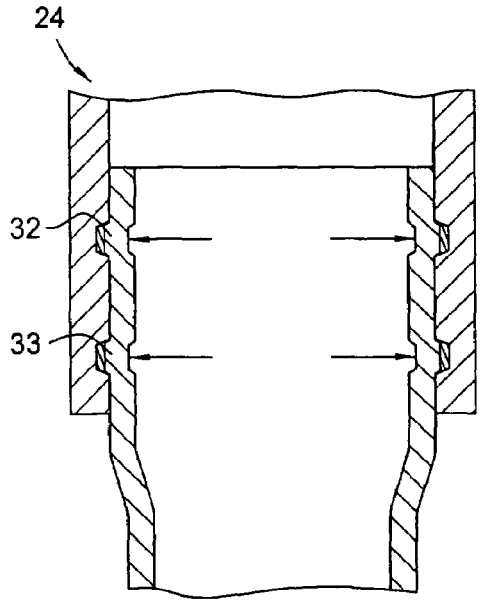

Reference is now made to FIGS. 3 and 4 of the drawings, which illustrate a liner hanger 24 in accordance with a second embodiment of the present invention. The method of forming the liner hanger 24 is substantially the same as described above, however the liner 26 is provided with bands of relatively soft material 28, 29 at the locations corresponding to the casing profiles 30, 31.

Accordingly, when the liner 25 is deformed to create the male profiles 32, 33, the bands of ductile metal 28, 29 extend into the casing profiles 29, 30 and deform to provide a sealing contact with the opposing surfaces of the profiles 29, 30.

Figure 5:
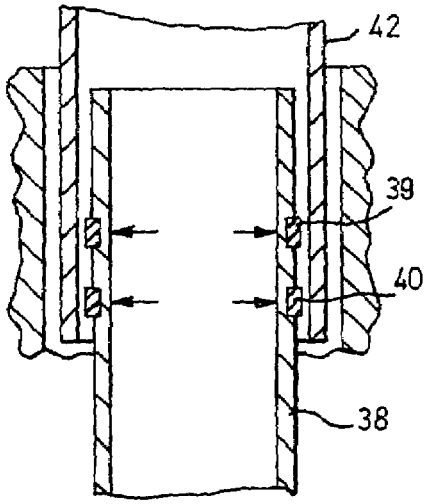
Figure 6:
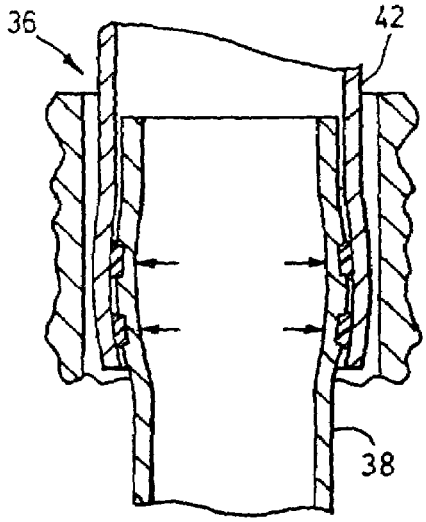

Reference is now made to FIGS. 5 and 6 of the drawings, which illustrate a liner hanger 36 in accordance with a third embodiment of the present invention. Like the second embodiment, liner 38 carries bands of relatively ductile material 39, 40, however there are no preformed profiles provided in the casing 42. In this embodiment, sufficient internal force is applied to the liner 38 to cause compressive plastic deformation of the liner 38 and subsequent radial expansion of the casing 42 up to and exceeding the casing yield point.

Figure 7:
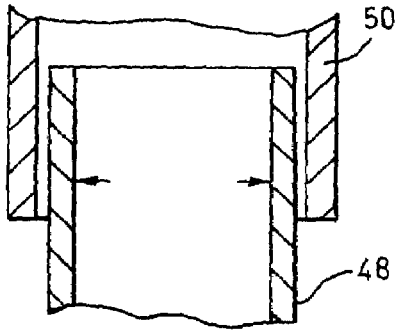
Figure 8:
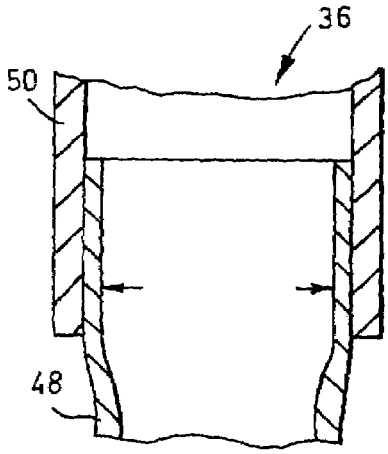

Reference is now made to FIGS. 7 and 8 of the drawings, which illustrate a liner hanger in accordance with a fourth embodiment of the present invention. In this embodiment, sufficient internal rolling compression and subsequent expansion of the upper section of the liner 48 creates high radial interference between the outside diameter of the upper section of the liner 48 and the inside diameter of the lower section of the casing 50.

Figure 9:
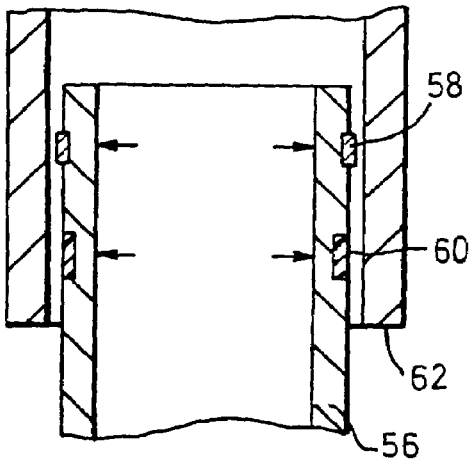
Figure 10:
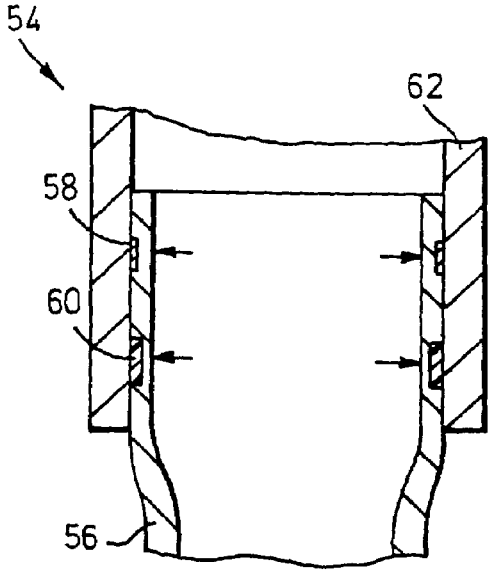

Reference is now made to FIGS. 9 and 10 of the drawings, which illustrates a liner hanger 54 in accordance with a fifth embodiment of the present invention. The method of formation of the liner hanger is similar to that of the liner hanger 46 as described above, however in this embodiment the outer face of the upper section of the liner 56 carries a band of ductile metal 58 and an annular elastomeric seal 60, such that on expansion of the liner 56 the metal 58 is deformed and flows between the liner 56 and the casing 62, and the seal 60 is brought into sealing contact with the casing 62.

Figure 11:
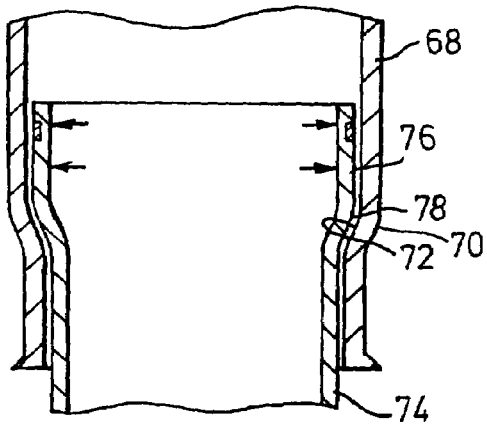
Figure 12:
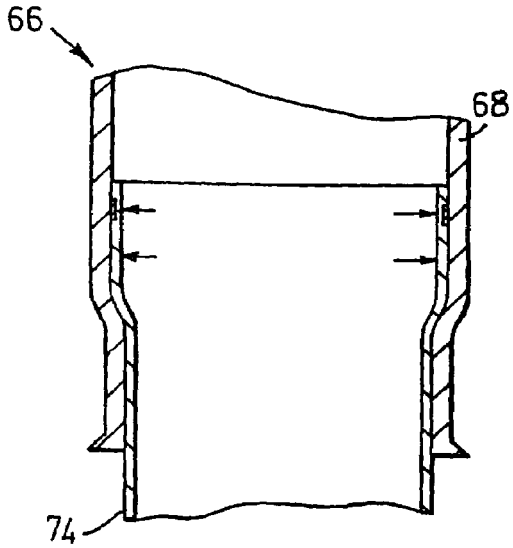

Reference is now made to FIGS. 11 and 12 of the drawings which illustrate a liner hanger 66 in accordance with a sixth embodiment of the present invention. In this embodiment, the casing 68 is formed of expandable tubing which has only been partially expanded at its lower end 70 to form a cone 72. The liner 74 is then run into the casing 68 and the liner top 76 expanded to form a matching cone 78 to the casing cone 72, such that the liner 74 may be hung from the casing 68. The upper end of the liner 74 is then subsequently expanded by compressive deformation to create a pressure seal, as illustrated in FIG. 12.

Reference is now made FIGS. 13 through 17, which illustrate the stages in the running and cementing of a liner in accordance with a preferred embodiment of the present invention, and also illustrate the apparatus which may be utilised to form a liner hanger.

Reference is first made to FIG. 13 of the drawings, which illustrates the liner 100 which has been run into the uncased section of a bore 102, below the lowermost casing section 104. An upper section of the liner 100*a* overlaps the lower end of the casing 104, this section of liner 100*a* being formed of a relatively ductile material and being welded to the upper end of the lower section of liner 100*b*. The liner 100 is run in to the bore on a running and cementing string 106, the liner 100 being mounted to the string 106 via a rotary hydraulic expander 108 and a locking swivel 110. The expander 108 is located at the upper end of the liner, with the swivel 110 below, and a wiper plug 112 is mounted to the lower end of the swivel 110. The liner 100 itself defines a stop collar 114 and the lower end of the liner 100 is provided with a float shoe 116 including two one-way valves 118.

The liner 100 is coupled to the swivel 110 by a series of retractable pins which, in the initial configuration, prevent relative axial movement between the string 106 and the liner 100. A further series of pins extends from the expander 108 and, in the initial configuration, prevent relative rotational movement between the string 106 and the liner 100.

From FIG. 13 it will be noted that the expander 108 and swivel 110 are tubular, such that cement and other fluids may be pumped from the surface through the string 106, and the expander 108 and the swivel 110 through the interior of the liner 100 and out from the valve 118 in the float shoe 116. As cement slurry is pumped in, as illustrated in FIG. 14 of the drawings, the fluid in the bore externally of the liner 100, and in particular the fluid in the annulus 120 between the liner 100 and the uncased bore wall 122 is displaced upwardly through the annular gap 124 between the lower end of the casing and the upper end of the liner. This fluid may be "clean" fluid pumped through the string 106 ahead of the cement, in order to displace the well fluid which originally occupied the annulus 120.

As the cement is being pumped into the annulus 120 the string 106 is rotated from surface, to ensure an even distribution of cement throughout the annulus 120. Suitable seals located above and below the expander 108 prevent contamination of the expander by cement during the cementing operation.

The predetermined volume of cement slurry that is pumped into the bore is followed by a dart 126, which is itself followed by clean mud or water; the dart 126 is pumped down through the string 106, the expander 108 and the swivel 110. The dart 126 lands in the wiper plug 112, and pulls the plug 112 from the swivel 110.

The dart 126 then continues to move downwardly through the string 106, with the wiper plug 112, to "clean" the interior of the liner, until the plug 112 engages the stop collar 114, as shown in FIG. 16.

At this point, the fluid pressure within the string 106 will increase, indicating that the cementing phase of the liner hanging operation is complete, and allowing activation of the rotary hydraulic expander 108. Reference should now also be made to FIGS. 18 and 19 of the drawings, which illustrate the schematic sections on lines 18—18 and 19—19 of FIGS. 15 and 16, respectively. The expander 108 comprises three rollers 128 mounted in a body 130 and radially movable relative to thereto. In the preferred embodiment, the rollers 128 have tapered ends for co-operating with a corresponding taper on an annular piston which, when exposed to elevated string bore pressure, moves axially within the expander body 130 and urges the rollers 128 radially outwards. FIG. 18 illustrates the initial position of the rollers 128 relative to the liner 100 and casing 104 (it should be noted that the diameters of the rollers 128 have been exaggerated), and on application of elevated fluid pressure to the interior of the expander 108 the rollers 128 are pushed outwardly, as illustrated in FIG. 19 of the drawings. The outward movement of the rollers 128 is such that the wall of the liner 100 is deformed to create three initial areas of contact 132 between the liner outside diameter and casing inside diameter, which prevent further relative rotation between the liner 100 and the casing 104. The deformation of the liner 100 also disengages the liner from the coupling pins on the expander 108, allowing relative rotation between the expander 108 and the liner 100.

The string 106 and expander 108 are then rotated from surface, and thus the expander 108 rotates relative to the liner 100, the rollers 128 progressing around the inner diameter of the liner 100, in rolling contact therewith.

The contact between the rollers 128 and the liner 100 causes compressive plastic deformation of the liner 100 and a localised reduction in wall thickness resulting in a subsequent increase in liner diameter, such that the liner outside diameter forms an interference fit with the casing inside diameter. Thus, a liner hanger, such as those as illustrated in FIGS. 1 to 12, may be created.

The running string 106, with the expander 108 and the swivel 110, is then pulled out of the hole, as shown in FIG. 17, the locking pins extending between the the swivel 110 is moved downwards as elevated fluid pressure is applied to the string 106.

It will be apparent to those of skill in the art that the liner hanger thus formed is relatively simple and slim in profile, thus providing enhanced reliability and minimising the loss of diameter between the casing and liner.

It will also be apparent to those of skill in the art that the above described embodiments are merely exemplary, and that various modifications and improvements may be made thereto without departing from the scope of the present invention. For example, although reference is made primarily herein to liner hangers, the invention may be utilised in locating and sealing many different forms of expandable tubing in existing tubing.

What is claimed is:

1. A method of installing a liner in a drilled bore lined with casing, comprising:

running the liner into the bore such that the liner is positioned in an at least partially overlapping relation with the casing;

deforming the casing to define an enlarged inner diameter portion prior to running the liner into the bore; and plastically deforming a portion of the liner to expand the portion of the liner into the overlapping casing resulting in a subsequent increase in inner and outer diameters of the liner and a corresponding increase in diameter of the casing.

2. The method of claim 1, wherein the portion of liner is deformed to create a pressure-tight seal between the liner and casing.

3. The method of claim 2, wherein the seal formed is a metal-to-metal seal.

4. The method of claim 1, further comprising:

further expanding the portion of the liner so as to radially deform a portion of the overlapping casing adjacent to the expanded portion of liner.

5. The method of claim 4, wherein deformation of the portion of the casing is plastic deformation.

6. The method of claim 4, wherein deformation of the portion of the casing is elastic deformation.

7. The method of claim 1, wherein the liner is initially secured relative to the casing by deforming the liner by radially extending circumferentially spaced areas of the liner to form corresponding areas of interference fit between the liner and the casing.

8. The method of claim 1, further comprising:

cementing the liner in the bore.

9. The method of claim 8, wherein the step of cementing is achieved by:

pumping cement from a surface to the lower end of the liner, directing the cement into the annulus between the liner and the bore wall, and displacing fluid from the annulus.

10. The method of claim 9, wherein the portion of the liner is expanded once the cement is in place in the annulus.

11. A method of installing a liner in a drilled bore lined with casing, comprising:

running the liner into the bore such that the liner is positioned in an at least partially overlapping relation with the casing;

plastically deforming a portion of the liner to expand the portion of the liner into the overlapping casing resulting in a subsequent increase in inner and outer diameters of the liner and a corresponding increase in diameter of the casing, wherein the portion of liner is deformed to create a pressure-tight seal between the liner and casing; and providing a portion of liner to be expanded with a band of relatively soft metal which is plastically deformed during the expansion of the liner portion.

12. A method of installing a liner in a drilled bore lined with casing, comprising:

running the liner into the bore such that the liner is positioned in an at least partially overlapping relation with the casing; and plastically deforming a portion of the liner to expand the portion of the liner into the overlapping casing resulting in a subsequent increase in inner and outer diameters of the liner; and cementing the liner in the bore, the cementing comprising:

pumping cement from a surface to the lower end of the liner;

directing the cement into the annulus between the liner and the bore wall;

displacing fluid from the annulus; and rotating the liner as the cement is passed into the annulus, wherein the portion of the liner is expanded once the cement is in place in the annulus.

13. A method of installing a liner in a drilled bore lined with casing, comprising:

running the liner into the bore such that the liner is positioned in an at least partially overlapping relation with the casing; and plastically deforming portion of the liner to expand the portion of the liner into the overlapping casing resulting in a subsequent increase in inner and outer diameters of the liner, wherein the liner is run into the bore on a running tool carrying an expander including a body and at least one radially extendable member mounted thereon, the running tool being rotatable to move the member around the portion of the liner to create the desired deformed portion.

* * * * *